US009423117B2

(12) United States Patent
Athalye

(10) Patent No.: US 9,423,117 B2
(45) Date of Patent: Aug. 23, 2016

(54) LED FIXTURE WITH HEAT PIPE

(75) Inventor: Praneet Athalye, Morrisville, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/341,741

(22) Filed: Dec. 30, 2011

(65) Prior Publication Data

US 2013/0170210 A1 Jul. 4, 2013

(51) Int. Cl.

| | |
|---|---|
| ***F21V 29/00*** | (2015.01) |
| ***F21V 29/71*** | (2015.01) |
| ***F21V 29/70*** | (2015.01) |
| ***F21V 29/503*** | (2015.01) |
| ***F21V 7/00*** | (2006.01) |
| *F21Y 101/02* | (2006.01) |

(52) U.S. Cl.

CPC ..... *F21V 29/006* (2013.01); *F21V 7/0008* (2013.01); *F21V 29/503* (2015.01); *F21V 29/70* (2015.01); *F21V 29/71* (2015.01); *F21V 29/717* (2015.01); *F21Y 2101/02* (2013.01)

(58) Field of Classification Search

CPC ..... F21V 29/006; F21V 29/265; F21V 29/51; F21V 29/52; F21V 29/56–29/59; F21V 29/70–29/717

USPC ..... 362/294, 373

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 362/223 |
| 3,381,124 | A | 4/1968 | Eisenberg | 362/354 |
| 4,939,627 | A | 7/1990 | Herst et al. | 362/299 |
| 5,025,356 | A | 6/1991 | Gawad | 362/221 |
| 5,823,663 | A | 10/1998 | Bell et al. | 362/362 |
| D407,473 | S | 3/1999 | Wimbock | D23/328 |
| 6,149,283 | A | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

Search Report and Written Opinion from PCT Patent Appl. No. PCT/US2012/047084, dated Feb. 27, 2013.

(Continued)

*Primary Examiner* — Mariceli Santiago

(74) *Attorney, Agent, or Firm* — Koppel, Patrick, Heybl & Philpott

(57) ABSTRACT

A light assembly fixture comprising a heat pipe to dissipate heat from the light emitting device, such as but not limited to a light emitting diode (LED). The assembly further comprises a housing including a front surface, a light emitting device on a first heat spreader remote from the front surface, a first end of a heat pipe in thermal contact with the first heat spreader and the heat pipe extending towards the front surface such that a second end of the heat pipe is in thermal contact with a second heat spreader that is disposed on the housing, wherein the first heat spreader, heat pipe and second heat spreader are configured to provide a thermal path to dissipate heat from the light emitting device.

50 Claims, 3 Drawing Sheets

(56) References Cited

U.S. PATENT DOCUMENTS 6,443,598 B1 9/2002 Morgan ..... 362/342
6,523,974 B2 2/2003 Engel ..... 362/224
6,578,979 B2 6/2003 Truttmann-Battig ..... 362/92
D496,121 S 9/2004 Santoro ..... D26/74
6,871,983 B2 3/2005 Jacob et al. ..... 362/364
6,948,840 B2 9/2005 Grenda et al. ..... 362/555
7,021,797 B2 4/2006 Minano et al. ..... 362/355
7,049,761 B2 5/2006 Timmermans et al. ..... 315/246
7,063,449 B2 6/2006 Ward ..... 345/102
7,175,296 B2 2/2007 Cok ..... 362/147
7,213,940 B1 5/2007 Van de Ven et al. ..... 362/231
7,217,004 B2 5/2007 Park et al. ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,438,440 B2 * 10/2008 Dorogi ..... 362/294
7,510,299 B2 3/2009 Timmermans et al. ..... 362/225
7,520,636 B2 4/2009 Van der Poel ..... 362/290
D593,246 S 5/2009 Fowler et al. ..... D25/76
7,559,672 B1 7/2009 Parkyn et al. ..... 362/244
7,594,736 B1 9/2009 Kassay et al. ..... 362/223
D604,446 S 11/2009 Fowler et al. ..... D26/76
7,618,157 B1 11/2009 Galvez et al. ..... 362/294
7,618,160 B2 11/2009 Chinniah et al. ..... 362/326
D608,932 S 1/2010 Castelli ..... D26/76
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
D633,247 S 2/2011 Kong et al. ..... D26/88
7,878,232 B2 * 2/2011 Arik et al. ..... 362/294
7,887,216 B2 2/2011 Patrick et al.
7,922,354 B2 4/2011 Everhart ..... 362/235
7,926,982 B2 4/2011 Liu ..... 362/294
7,988,321 B2 8/2011 Wung et al. ..... 362/218
7,988,335 B2 8/2011 Liu et al. ..... 362/294
7,991,257 B1 8/2011 Coleman
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,167,459 B2 * 5/2012 Wang ..... 362/294
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. ... 362/294
8,246,219 B2 8/2012 Teng et al. ..... 362/311.03
8,256,927 B2 9/2012 Hu ..... 362/218
D670,849 S 11/2012 Lay et al. ..... D26/74
8,317,354 B2 11/2012 Gassner et al. ..... 362/147
D679,848 S 4/2013 Pickard et al. ..... D26/74
8,410,514 B2 4/2013 Kim ..... 257/99
D684,291 S 6/2013 Goelz et al. ..... D26/74
8,480,252 B2 7/2013 Bertram et al. ..... 362/243
8,506,135 B1 * 8/2013 Oster ..... 362/373
8,591,058 B2 11/2013 Concepcion ..... 362/231
8,591,071 B2 11/2013 Hochstein ..... 362/294
8,602,601 B2 12/2013 Khazi ..... 362/249.02
D698,975 S 2/2014 Blessit et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,764,244 B2 7/2014 Jeon ..... 362/218
D714,988 S 10/2014 Park et al. ..... D26/74
D721,198 S 1/2015 Glasbrenner ..... D26/76
9,052,075 B2 6/2015 Demuynck et al.
2003/0063476 A1 4/2003 English et al.
2003/0214803 A1 * 11/2003 Ono et al. ..... 362/1
2004/0001344 A1 1/2004 Hecht ..... 362/555
2004/0085779 A1 5/2004 Pond et al. ..... 362/516
2004/0100796 A1 5/2004 Ward
2004/0213016 A1 * 10/2004 Rice ..... 362/547
2004/0240230 A1 12/2004 Kitajima ..... 362/558
2005/0180135 A1 8/2005 Mayer ..... 362/240
2005/0264716 A1 12/2005 Kim et al.
2005/0281023 A1 12/2005 Gould ..... 362/217
2006/0221611 A1 10/2006 No ..... 362/247
2006/0262521 A1 11/2006 Piepgras et al. ..... 362/149
2006/0291206 A1 12/2006 Angelini et al. ..... 362/244
2007/0070625 A1 3/2007 Bang ..... 362/240
2007/0109779 A1 5/2007 Sekiguchi et al.
2007/0115670 A1 5/2007 Roberts et al.
2007/0115671 A1 5/2007 Roberts et al.
2007/0211457 A1 9/2007 Mayfield et al. ..... 362/223
2007/0253205 A1 11/2007 Welker ..... 362/373
2007/0279909 A1 * 12/2007 Li ..... 362/294
2007/0297181 A1 12/2007 Mayfield et al. ..... 362/342
2008/0019147 A1 1/2008 Erchak ..... 362/607
2008/0049422 A1 2/2008 Trenchard et al. ..... 362/238
2008/0232093 A1 9/2008 Kim ..... 362/147
2008/0278943 A1 11/2008 Van Der Poel ..... 362/240
2009/0034247 A1 2/2009 Boyer ..... 362/225
2009/0073693 A1 3/2009 Nall ..... 362/249.02
2009/0161356 A1 6/2009 Negley et al. ..... 362/231
2009/0168439 A1 7/2009 Chiang ..... 362/404
2009/0196024 A1 8/2009 Heiking et al. ..... 362/150
2009/0225543 A1 9/2009 Roberts et al.
2009/0237958 A1 9/2009 Kim
2009/0262543 A1 10/2009 Ho ..... 362/373
2009/0296388 A1 12/2009 Wu et al. ..... 362/235
2009/0310354 A1 12/2009 Zampini et al. ..... 362/235
2009/0323334 A1 12/2009 Roberts et al.
2010/0061108 A1 3/2010 Zhang et al. ..... 362/364
2010/0097794 A1 * 4/2010 Teng et al. ..... 362/231
2010/0103678 A1 * 4/2010 Van De Ven et al. ..... 362/294
2010/0110679 A1 5/2010 Teng et al.
2010/0172133 A1 7/2010 Lie ..... 362/235
2010/0177532 A1 7/2010 Simon et al.
2010/0188609 A1 7/2010 Matsuki et al.
2010/0253591 A1 10/2010 Hwu et al. ..... 345/1.3
2010/0254128 A1 10/2010 Pickard et al. ..... 362/231
2010/0254145 A1 10/2010 Yamaguchi
2010/0254146 A1 10/2010 McCanless
2010/0270903 A1 10/2010 Jao et al. ..... 313/46
2010/0271843 A1 10/2010 Holten et al. ..... 362/609
2010/0277905 A1 11/2010 Janik et al. ..... 362/235
2010/0295468 A1 11/2010 Pedersen et al. ..... 315/294
2010/0327768 A1 12/2010 Kong et al. ..... 315/294
2011/0032714 A1 * 2/2011 Chang ..... 362/373
2011/0043132 A1 2/2011 Kim et al.
2011/0090671 A1 4/2011 Bertram et al. ..... 362/84
2011/0141722 A1 6/2011 Acampora et al. ..... 362/218
2011/0141734 A1 6/2011 Li et al. ..... 362/235
2011/0156584 A1 6/2011 Kim ..... 315/32
2011/0164417 A1 7/2011 Huang ..... 362/235
2011/0175533 A1 7/2011 Homan ..... 315/130
2011/0199005 A1 8/2011 Bretschneider et al.
2011/0199769 A1 8/2011 Bretschneider et al.
2011/0227507 A1 * 9/2011 Salm ..... 362/294
2011/0246146 A1 10/2011 Kauffman et al. ..... 703/2
2011/0255292 A1 10/2011 Shen ..... 362/311
2011/0267810 A1 11/2011 Higman et al. ..... 362/218
2011/0267823 A1 11/2011 Angelini et al. ..... 362/277
2011/0305024 A1 12/2011 Chang ..... 362/294
2012/0033420 A1 2/2012 Kim et al. ..... 362/235
2012/0038289 A1 2/2012 Jee et al. ..... 315/291

(56) References Cited

U.S. PATENT DOCUMENTS

| | | | | |
|---|---|---|---|---|
| 2012/0051041 | A1 | 3/2012 | Edmond et al. | 362/231 |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2013/0235568 | A1 | 9/2013 | Green et al. | 362/218 |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | | |
|---|---|---|---|---|
| CN | 1963289 | A | | 5/2007 |
| CN | 101188261 | | | 5/2008 |
| CN | 101660715 | | | 3/2010 |
| CN | 101776254 | | | 7/2010 |
| CN | 101776254 | A | | 7/2010 |
| CN | 101790660 | | | 7/2010 |
| CN | 101790660 | A | | 7/2010 |
| CN | 102072443 | | | 5/2011 |
| CN | 202580962 | | | 12/2012 |
| DE | 102007030186 | | | 1/2009 |
| DE | 202010001832 | | | 7/2010 |
| EP | 1298383 | A2 | | 4/2003 |
| EP | 1357335 | A2 | | 10/2003 |
| EP | 1653254 | | | 3/2006 |
| EP | 1737051 | | | 12/2006 |
| EP | 1847762 | A2 | | 10/2007 |
| EP | 1860467 | | | 11/2007 |
| EP | 2287520 | A2 | | 2/2011 |
| EP | 2290690 | A2 | | 3/2011 |
| EP | 2636945 | A2 | | 9/2013 |
| GB | 774198 | | | 5/1957 |
| JP | 1069809 | | | 3/1998 |
| JP | 2002244027 | | | 11/2002 |
| JP | U3097327 | | | 8/2003 |
| JP | 2004140327 | | | 5/2004 |
| JP | 2004345615 | | | 12/2004 |
| JP | 2004345615 | A | | 12/2004 |
| JP | 2006173624 | | | 6/2006 |
| JP | 2008108721 | A | * | 5/2008 |
| JP | 2008147044 | | | 6/2008 |
| JP | 3151501 | U | | 6/2009 |
| JP | 2009295577 | | | 12/2009 |
| JP | 2010103687 | | | 5/2010 |
| JP | 2011018571 | | | 8/2011 |
| JP | 2011018572 | | | 8/2011 |
| TW | 200524186 | | | 7/2005 |
| TW | 201018826 | | | 5/2010 |
| TW | 201018826 | A | | 5/2010 |
| WO | WO 03102467 | | | 12/2003 |
| WO | WO 2009030233 | | | 3/2009 |
| WO | WO 2009140761 | A1 | | 11/2009 |
| WO | 2009157999 | A | | 12/2009 |
| WO | WO 2009157999 | | | 12/2009 |
| WO | WO 2009157999 | A1 | | 12/2009 |
| WO | 2010024583 | A2 | | 3/2010 |
| WO | WO 2010024583 | | | 3/2010 |
| WO | WO 2010042216 | | | 4/2010 |
| WO | WO 2010042216 | A2 | | 4/2010 |
| WO | WO 2011074424 | A1 | | 6/2011 |
| WO | WO 2011096098 | A1 | | 8/2011 |
| WO | WO 2011098191 | | | 8/2011 |
| WO | WO 2011118991 | A2 | | 9/2011 |
| WO | WO 2011140353 | A2 | | 11/2011 |
| WO | WO 03102467 | | | 12/2013 |

OTHER PUBLICATIONS

Search Report and Written Opinion from PCT Patent Appl. No. PCT/US2012/071800, dated Mar. 25, 2013.
International Search Report and Written Opinion for Patent Application No. PCT/US2011/001517, dated: Feb. 27, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion from PCT Application No. PCT/US2013/021053, dated Apr. 17, 2013.
U.S. Appl. No. 12/873,303, filed Aug. 31, 2010 to Edmond, et al.
Cree's XLamp XP-E LED's, data sheet, pp. 1-16, www.cree.com/xlamp 2008-2010.
Cree's XLamp XP-G LED's, data sheet, pp. 1-12, www.cree.com/xlamp 2009-2011.
Notice to Submit a Response from Korean Patent Application No. 30-2011-0038115, dated Dec. 12, 2012.
Notice to Submit a Response from Korean Patent Application No. 30-2011-0038116. dated Dec. 12, 2012.
International Search Report and Written Opinion for PCT Application No. PCT/US2011/062396, dated Jul. 13, 2012.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion from PCT/US2013/049225, dated Oct. 24, 2013.
Preliminary Report and Written Opinion from PCT appl. No. PCT/US2012/047084, dated Feb. 6, 2014.
International Search Report and Written Opinion from Appl. No. PCT/CN2013/072772, dated Dec. 19, 2013.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/370,252, dated Dec. 20, 2013.
Office Action from U.S. Appl. No. 13/429,080, dated Apr. 18, 2014.
Office Action from U.S. Appl. No. 12/961,385, dated Mar. 11, 2014.
Office Action from U.S. Appl. No. 13/464,745, dated Jul. 16, 2014.
International Preliminary Report on Patentability and Written Opinion from PCT/US2013/021053, dated Aug. 21, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Communication from European Patent Appl. No. 13701525.1-1757, dated Sep. 26, 2014.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.

(56) References Cited

OTHER PUBLICATIONS

Office Action from U.S. Appl. No. 13/189,535, dated Jan. 13, 2015.
First Official Action from European Patent Appl. No. 12 743 003.1-1757, dated Jan. 16, 2015.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; Jan. 6, 2016.
Office Action from U.S. Appl. No. 13/873,303; Feb. 2, 2016.
Office Action from U.S. Appl. No. 13/464,745; Mar. 1, 2016.
Office Action from U.S. Appl. No. 14/716,480; Mar. 3, 2016.
Office Action from U.S. Appl. No. 13/368,217; Mar. 4, 2016.
Office Action from U.S. Appl. No. 13/189,535; Mar. 18, 2016.
Office Action from U.S. Appl. No. 14/020,757; Apr. 7, 2016.
Office Action from U.S. Appl. No. 29/466,391; May 10, 2016.
Second Office Action for Application No. 2011800588770; Dated Mar. 29, 2016.
Office Action for U.S. Appl. No. 13/828,348; Dated Jun. 2, 2016.
Notice of Reason for Rejection for Japanese Appl. No. 2013-543207; Dated May 24, 2016.

* cited by examiner

FIG. 3A
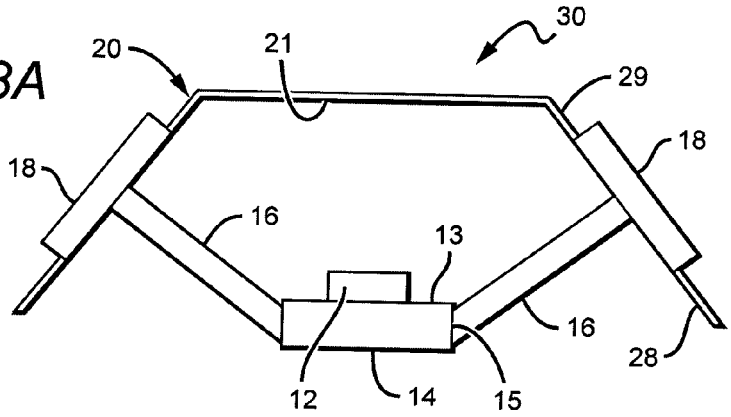
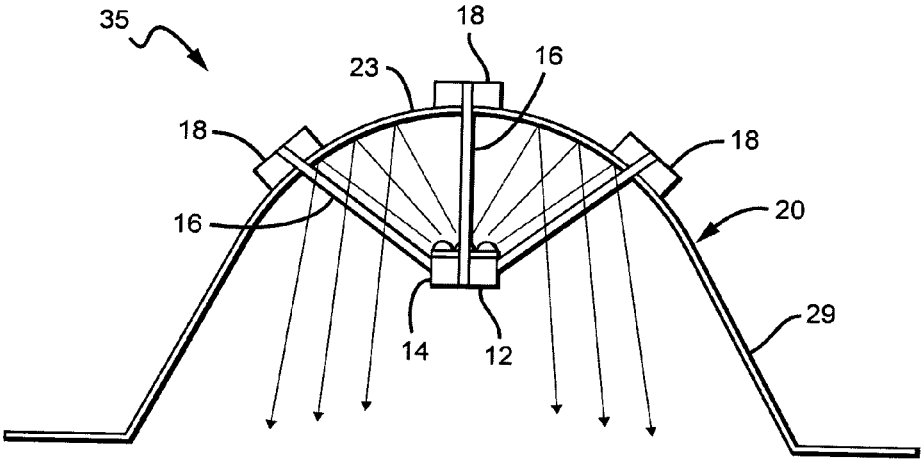
FIG. 3B
FIG. 3C
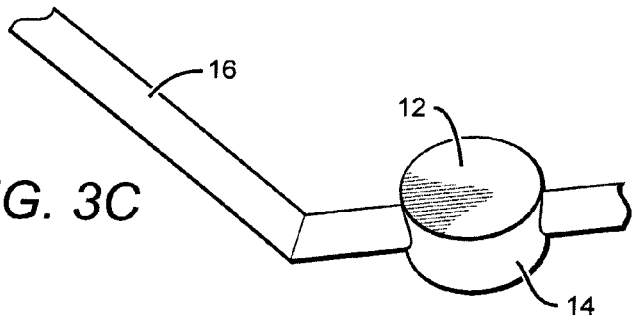

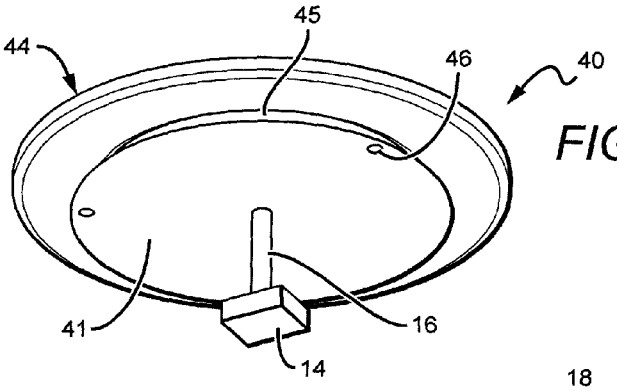
FIG. 4
FIG. 5
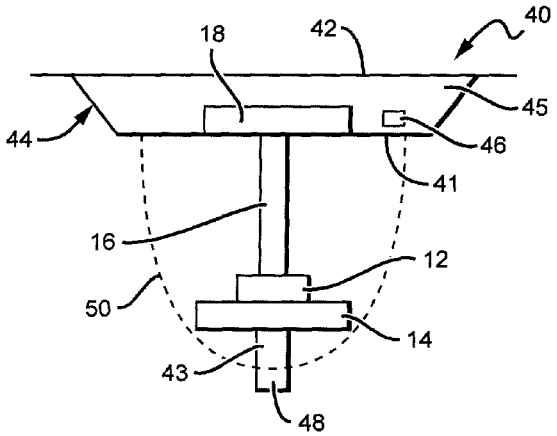
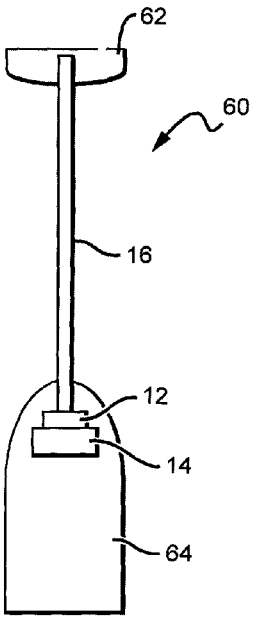
FIG. 6
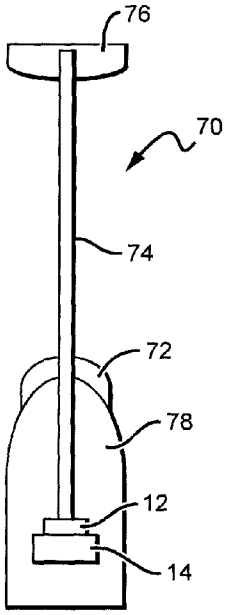
FIG. 7
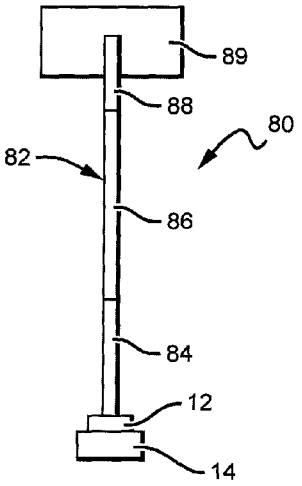
FIG. 8

LED FIXTURE WITH HEAT PIPE

BACKGROUND OF THE INVENTION

1. Field of the Invention

The invention relates to a light emitting device assembly that can provide lighting and is well-suited for use with solid state lighting sources, such as light emitting diodes (LEDs).

2. Description of the Related Art

Lighting fixtures are ubiquitous in commercial offices, industrial and residential spaces throughout the world. In many instances the lighting fixtures, for example troffer fixtures, are mounted to or suspended from ceilings, or even recessed into the ceiling and house elongated fluorescent light bulbs that span the length of the troffer. In instances when the troffer is recessed into the ceiling, the back side of the troffer protrudes into the plenum area above the ceiling. Elements of the troffer fixture can be included on the back side to dissipate heat generated by the light source into the plenum where air can be circulated to facilitate the cooling mechanism.

More recently, with the advent of the efficient solid state lighting sources, LEDs have been used as the source for indirect lighting, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY

The invention provides various embodiments of light emitting device assemblies that are efficient, reliable and cost effective and can be arranged to provide a direct or indirect lighting scheme. The different embodiments comprise elements to displace the light source remote from the housing, such that the displacing elements are thermally conductive to conduct heat from the light source to the housing. The displacing elements can comprise many different materials or devices arranged in different ways, with some assemblies comprising heat pipe displacing elements coupled to one or more heat spreaders.

In one embodiment, as broadly described herein, a lighting assembly comprises a housing including a front surface, a light emitting device on a first heat spreader remote from the front surface, a first end of a heat pipe in thermal communication with the first heat spreader and the heat pipe extending towards the front surface such that a second end of the heat pipe is in thermal communication with a second heat spreader that is disposed on an external surface of the housing. The first heat spreader, heat pipe and second heat spreader forming a thermally conductive path to conduct heat away from the first end of the heat pipe towards the second end of the heat pipe. A reflector is proximate to the light emitting device, the reflector comprising a reflective surface facing the housing. A diffuser can also be included to diffuse light emitting from the light emitting device into the desired emission pattern.

In another embodiment, a lighting assembly comprises a housing comprising a back surface and angled sidewalls, a plurality of heat spreaders wherein a first heat spreader has a mount surface and a light emitting device mounted on the mount surface and at least one second heat spreader on an external surface of the housing. Each of the one or more heat pipes in thermal communication with the first heat spreader and the at least one second heat spreader. The back surface of the housing can be planar, curved, multi-faceted or a combination thereof. In some embodiments, the at least one second heat spreader can be on an external surface of the angled sidewalls of the housing, the back surface of the housing, or a combination thereof. The first heat spreader, heat pipe and the at least one second heat spreader forming a thermally conductive path to conduct heat away from the light emitting device.

These and other aspects and advantages of the invention will become apparent from the following detailed description and the accompanying drawings which illustrate by way of example the features of the invention.

BRIEF DESCRIPTION OF THE DRAWINGS

FIG. 3A is a cross-sectional view of a lighting assembly according to an embodiment of the invention.

FIG. 3B is a cross-sectional view of a lighting assembly according to an embodiment of the invention.

FIG. 3C is a perspective view of a lighting assembly according to an embodiment of the invention.

FIG. 4 is a perspective view of a lighting assembly according to an embodiment of the invention.

FIG. 5 is a cross-sectional view of the lighting assembly of FIG. 4.

FIG. 6 is a cross-sectional view of a lighting assembly according to an embodiment of the invention.

FIG. 7 is a cross-sectional view of a lighting assembly according to an embodiment of the invention.

FIG. 8 is a cross-sectional view of a lighting assembly according to an embodiment of the invention.

DETAILED DESCRIPTION

Figure 1:
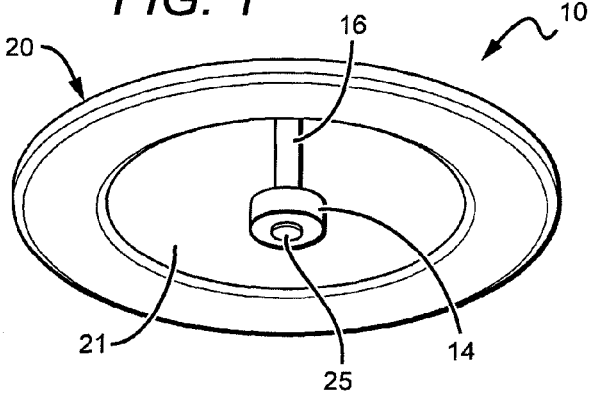
FIG. 1 is a perspective view of a lighting assembly according to an embodiment of the invention.

The invention described herein is directed to different embodiments of light emitting device assemblies that in some embodiments provide displacing elements to mount a light source remote from a housing of the assembly. The displacing elements can comprise many different thermally conductive materials, as well as multiple material devices arranged to conduct heat. In some embodiments, the elements can comprise a first heat spreader including a mounting surface to mount one or more LEDs, and one or more heat pipes, wherein the LEDs are arranged to emit substantially all light towards the housing where it can be mixed and/or shaped before it is emitted from the housing as useful light. One end of the heat pipe is in thermal contact with the first heat spreader and the other end of the heat pipe can be mounted to a second heat spreader that is on an external surface of the housing, such that the orientation of the one or more heat pipes displaces the LEDs from the housing. The heat pipes also conduct heat from the LEDs to the second heat spreader where the heat can efficiently radiate into the ambient. In some embodiments the housing is made of thermally conductive materials such that the housing further assists in the dissipation of heat. This arrangement allows for the LEDs to operate at a lower temperature, while allowing the LEDs to remain remote from the housing. In addition, a thermally conductive housing could eliminate the need of an active cooling system, thereby reducing manufacturing costs. However, in other embodiments, an active cooling system could be present to assist in the heat dissipation. The thermally conductive housing would allow for the LEDs to be driven with a higher drive signal to produce a higher luminous flux. Operating at lower temperatures can provide the additional advantage of improving the LED emission and increase the lifespan of the assembly.

Heat pipes are generally known in the art and are only briefly discussed herein. Heat pipes can comprise a heat-transfer device that combines the principles of both thermal conductivity and phase transition to efficiently manage the transfer of heat between two interfaces. At the hot interface (i.e. interface with LEDs) within a heat pipe, a liquid in contact with a thermally conductive solid surface turns into a vapor by absorbing heat from that surface. The vapor condenses back into a liquid at the cold interface, releasing the latent heat. The liquid then returns to the hot interface through either capillary action or gravity action where it evaporates once more and repeats the cycle. In addition, the internal pressure of the heat pipe can be set or adjusted to facilitate the phase change depending on the demands of the working conditions of the thermally managed system.

A typical heat pipe is comprised of a sealed pipe or tube made of a material with high thermal conductivity, such as copper or aluminum at least at both the hot and cold ends. A vacuum pump can be used to remove air from the empty heat pipe, and the pipe can then be filled with a volume of working fluid (or coolant) chosen to match the operating temperature. Examples of such fluids include water, ethanol, acetone, sodium, or mercury. Due to the partial vacuum that can be near or below the vapor pressure of the fluid, some of the fluid can be in the liquid phase and some will be in the gas phase.

Displacing the LEDs on the first heat spreader remote from the housing can provide a number of additional advantages beyond those mentioned above. Mounting the LEDs on the first heat spreader remote from the housing allows for a concentrated LED light source that more closely resembles a point source. The LEDs can be mounted close to one another on the first heat spreader with very little separation between adjacent LEDs. This can result in a light source where the individual LEDs are less visible and can provide overall lamp emission with enhanced color mixing. Additionally, the heat pipe could be configured vertically or at an upward vertical angle such that the LEDs are below the housing and this configuration would allow gravity to assist in the operation of the heat pipe. The LEDs being below the housing and arranged to emit substantially all light towards the housing allows for the housing to be used to shape and/or mix the light before it is emitted from the housing as useful light. As such, a lens could be eliminated thereby providing a lens-free construction which further reduces manufacturing costs. However, in some embodiments, a lens could be included.

Different embodiments of the invention can incorporate diffuser domes wherein the LEDs are on the first heat spreader within the diffuser dome. In this arrangement, the LEDs are arranged to emit substantially all light downward such that the assembly is a down-light source. A second heat spreader is mounted to a ceiling and the heat pipe extends from the first heat spreader to the second heat spreader to form the thermal conductive path. The diffuser not only serves the purpose of concealing the internal components of the assembly from the view of a user, but can also mix and/or shape the light into a desired emission pattern. In other embodiments, the second heat spreader can be mounted to the external surface of the diffuser, instead of being mounted to a ceiling, and a mounting bracket is mounted to the ceiling wherein a cord or the like is connected to the mounting bracket and the diffuser so as to suspend the diffuser and LED from the ceiling. This arrangement allows for a shorter length of the heat pipe to be used and allows the length that the diffuser and LED are suspended from the ceiling to be easily adjusted without interfering with the heat dissipating elements.

The invention is described herein with reference to certain embodiments, but it is understood that the invention can be embodied in many different forms and should not be construed as limited to the embodiments set forth herein. In particular, the present invention is described below in regards to certain lighting components having LEDs, LED chips or LED components in different configurations, but it is understood that the invention can be used for many other lamps having many different configurations. The components can have different shapes and sizes beyond those shown and different numbers of LEDs or LED chips can be included. Many different commercially available LEDs can be used such as those commercially available from Cree, Inc. These can include, but not limited to Cree's XLamp® XP-E LEDs or XLamp® XP-G LEDs.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

As used herein, the term "source" can be used to indicate a single light emitter or more than one light emitter functioning as a single source. For example, the term may be used to describe a single blue LED, a blue-shifted-yellow (BSY) LED, or it may be used to describe a red LED and a green LED in proximity emitting as a single source. Thus, the term "source" should not be construed as a limitation indicating either a single-element or a multi-element configuration unless clearly stated otherwise.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 2A:
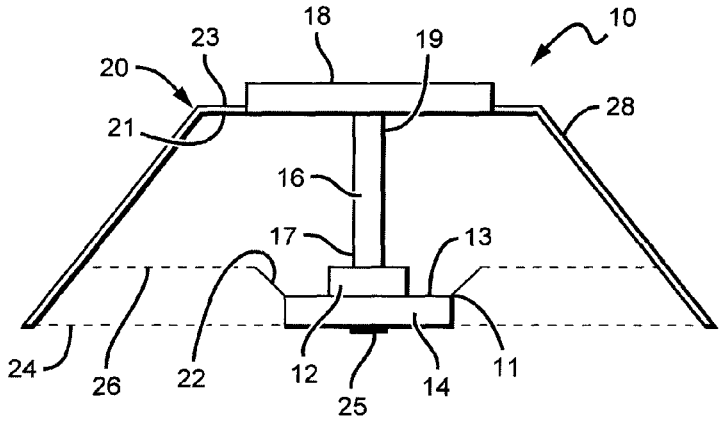
FIG. 2A is a cross-sectional view of the lighting assembly of FIG. 1.

With reference to FIGS. 1 and 2A, an exemplary lighting assembly 10 is shown. In some embodiments the lighting assembly 10 is configured such that the assembly 10 can be recessed into a wall or ceiling and used in conjunction with a power supply. The assembly 10 comprises a housing 20 including a front surface 21 on one side and a back surface 23 opposite the front surface 21. A light emitting device 12, for example an LED, is mounted on a first heat spreader 14, such that the light emitting device on the first heat spreader 14 is remote from the front surface 21 of the housing 20.

To facilitate the dissipation of unwanted thermal energy away from the light emitting device 12, a heat pipe 16 is disposed proximate to the first heat spreader 14. A first end 17 of the heat pipe 16 is coupled to the first heat spreader 14 and the heat pipe 16 extends towards the front surface 21 of the housing 20. The first heat spreader 14, which is exposed to the ambient room environment, comprises an opening to receive the first end 17 of the heat pipe 16. A second heat spreader 18 is disposed on the back surface 23 of the housing 20 and a second end 19 of the heat pipe 16 is coupled to the second heat spreader 18. The second heat spreader 18 has an opening to receive the second end 19 of the heat pipe 16. The length of the heat pipe 16 determines the separation distance between the light emitting device 12 and the housing 20. The length of the heat pipe 16 is selected to properly displace the light source remote from the front surface 21 to provide an efficient thermal path, in accordance with a desired lighting output. The heat pipe 16 is also adapted to provide structural support for the first heat spreader 14.

The portion of the first heat spreader 14 that faces the front surface 21 of the housing 20 functions as a mount surface 13 for the light emitting device 12. One or more light emitting devices 12 can be disposed on the mount surface 13 of the first heat spreader 14. In operation, substantially all light emitted from the light emitting devices 12 is directed towards the housing 20 where it can be mixed and/or shaped before it is emitted from the housing 20 as useful light. Emitting the light to the housing 20 allows the assembly 10 to operate as an indirect light source. The first heat spreader 14 can also comprise a reflector 22 adjacent the light emitting device 12 to direct substantially all light towards the front surface 21. In another embodiment, the assembly 10 comprises a lens that encases the light emitting device 12. The lens can comprise light altering properties similar to the housing 20. In yet other embodiments, the first heat spreader 14 can be configured to have a region 25 opposite the mount surface 13 that assists in the emission of a uniform light, such that the emitted light does not have an unpleasant glare or hot spots. For example, the region 25 could be a darkened region that can soften the emitted light in instances of high concentration of light is directly underneath the assembly.

The housing 20 further comprises sidewalls 28 adjacent the front surface 21 and are configured such that the sidewalls 28 may be angled, curved, multi-faceted or a combination thereof to assist in shaping and/or mixing the light. The sidewalls 28 and the front surface 21 may comprise many different materials. For many indoor lighting applications, it is desirable to present a uniform, soft light source without unpleasant glare, color stripping, or hot spots. Thus, the sidewalls 28 and front surface 21 may comprise a diffuse white reflector such as a microcellular polyethylene terephthalate (MCPET) material or a Dupont/WhiteOptics material, for example. Other white diffuse reflective materials can also be used, such as but not limited to reflective paint. The housing 20 can be formed of metal, steel, aluminum, any other material that is thermally conductive or a combination thereof. However, in other embodiments the housing 20 can be formed of non-thermally conductive materials. The housing 20 may be in the form of many different shapes. For example, in one embodiment, the front surface 21 is planar with sidewalls 28 adjacent the front surface 21. In other embodiments, the front surface 21 of the housing is a curved surface with the sidewalls 28 adjacent the curved surface.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with other sources of light, e.g., yellow light to yield a white light output. In some embodiments, the sidewalls 28 and front surface 21 may be coated with a phosphor material that converts the wavelength of at least some of the light from the light emitting diodes to achieve a light output of the desired color point when the assembly 10 is in operation.

By using a diffuse white reflective material for the sidewalls 28 and front surface 21 and by positioning the light emitting device 12 to emit light first toward the sidewalls 28 and front surface 21 several design goals are achieved. For example, the sidewalls 28 and front surface 21 perform a color-mixing function, effectively doubling the mixing distance and greatly increasing the surface area of the light emitting device. Additionally, the surface luminance is modified from a bright, uncomfortable point source to a much larger, softer diffuse reflection. A diffuse white material also provides a uniform luminous appearance in the output.

The sidewalls 28 and front surface 21 can comprise materials other than diffuse reflectors. In other embodiments, the sidewalls 28 and front surface 21 can comprise a specular reflective material or a material that is partially diffuse reflective and partially specular reflective. In some embodiments, it may be desirable to use a specular material in one area and a diffuse material in another area.

The heat pipe 16 is a typical heat pipe known in the art and is only discussed briefly herein. Heat pipes have tremendously higher thermal conductivity than copper or aluminum and can move significant heat from a concentrated light source. The first and second heat spreaders 14, 18 at either end of the heat pipe 16 aid in efficient heat dissipation. Heat pipe 16 can also be covered with Dupont/WhiteOptics material, similar to the front surface 21 and sidewalls 28 so as to not block emitted light, affect color mixing or otherwise negatively affect light emission during operation. Additionally, electrical wires from a power supply to provide power to the light emitting device 12 may run alongside the heat pipe 16 and also be covered by the Dupont/WhiteOptics material. However, the heat pipe and electrical wires may be covered with other material, similar to the front surface 21 and sidewalls 28 as discussed above. An advantage of the heat pipe 16 is that the length of the heat pipe between the first and second heat spreaders 14, 18 can be minimized to efficiently dissipate heat from the light emitting device 12 and the housing 20.

A thermally conductive adhesive can be used to mount second heat spreader 18 onto the back surface 23. However, a non-thermally conductive adhesive can also be used. In other embodiments the second heat spreader 18 can be mounted to the housing 20 using a screw, a bolt, rivet or the like. The second heat spreader 18 on the back surface 23 allows the housing 20 to be used to further dissipate heat from the light emitting device when in use. An advantage of utilizing the thermally conductive properties of the housing 20 to dissipate heat eliminates the need for a dedicated heat sink to dissipate heat. As such, the overall height of the lighting assembly 10 is decreased, which also reduces manufacturing costs.

The first and second heat spreaders 14, 18 can be constructed using many different thermally conductive materials. For example, the first and second heat spreaders 14, 18 may comprise an aluminum body. The first and second heat spreaders 14, 18 can also be extruded for efficient, cost-effective production and convenient scalability.

Figure 2B:
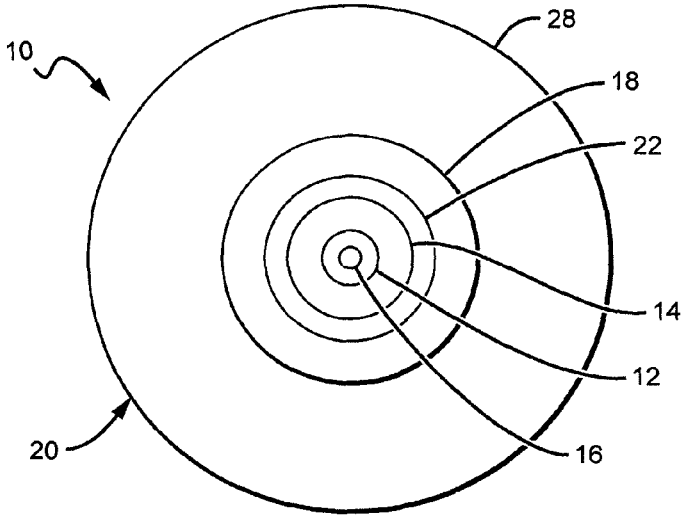
FIG. 2B is an overhead view of the lighting assembly of FIG. 2.

The first heat spreader 14 provides a substantially flat area on which one or more light emitting devices can be mounted. Although LEDs are used as the light emitting devices in various embodiments described herein, it is understood that other light sources, such as laser diodes for example, may be substituted in as the light sources in other embodiments of the invention. FIG. 2B shows an overhead view of the assembly of FIG. 2A. In the embodiment of FIG. 2B, the first and second heat spreaders and 18 are disc-shaped with an opening along a central vertical axis to receive the heat pipe 16. However, the first heat spreader 14 is not limited to disk-shaped configurations, and may be in the form of any shape, such as but not limited to rectangle, triangle or any other polygon.

The housing 20, in FIGS. 2A & 2B, is similar to an individual recessed light can. However, in other embodiments, the housing 20 can come in different shapes and sizes, for example a 2'×4' troffer or a wall sconce. In yet other embodiments, the housing 20 can accommodate more than one heat pipe/heat spreaders configurations. In embodiments where the housing 20 is a troffer-style light fixture, the housing 20 can comprise a single light emitting device 12 and heat pipe 16 or a plurality of light emitting devices 12 and a plurality of corresponding heat pipes 16. The troffer housing may be mounted to or suspended from a ceiling. In other embodiments, the troffer housing may be recessed into the ceiling, with the back side of the troffer protruding into the plenum area above the ceiling.

Many industrial, commercial, and residential applications call for white light sources. The assembly 10 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow) light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al., herein incorporated by reference.

In the embodiment of the assembly 10, in FIGS. 1, 2A and 2B, the first heat spreader 14 is exposed to the ambient environment. This structure is advantageous for several reasons. For example, air temperature in a typical residential or commercial room is much cooler than the air above the fixture (or the ceiling if the fixture is mounted above the ceiling plane). The air beneath the fixture is cooler because the room environment must be comfortable for occupants; whereas in the space above the fixture, cooler air temperatures are much less important. Additionally, room air is normally circulated, either by occupants moving through the room or by heating, ventilation, and air conditioning (HVAC) systems. The movement of air throughout the room helps to break the boundary layer, facilitating thermal dissipation from the first heat spreader 14.

FIG. 3A discloses an assembly 30 that is another embodiment of the invention. For the same or similar elements or features, the reference numbers from FIGS. 1 and 2A/B, will be used throughout the application herein. The assembly 30 comprises one or more heat pipes 16 coupled to the first heat spreader 14. In the embodiment of FIGS. 1, 2A and 2B, the heat pipe 16 is coupled to the first heat spreader 14 at a central vertical axis. However, in the embodiment disclosed in FIG. 3, the one or more heat pipes 16 are coupled to the first heat spreader 14 at a side surface 15 of the first heat spreader 14. The one or more heat pipes 16 extend towards the sidewalls 28, instead of the front surface 21. A corresponding one or more second heat spreaders 18 are disposed on an external surface 29 of the sidewalls 28 of the housing 20 and are configured to receive a respective heat pipe 16. In this embodiment, the heat pipes 16 extend towards the housing 20 at an angle which thereby allows the front surface 21 of the housing 20 to be unobstructed, such that the heat pipes 16 do not block light emitted from the light emitting device when in operation. In other embodiments, the heat pipes 16 can be configured to be coupled to the first heat spreader 14 at the mount surface 13 where the light emitting device 12 is mounted, instead of the side surface 15. In yet other embodiments, the heat pipes 16 are coupled to an edge 11, formed by the intersection of the mount surface 13 and the side surface 15, and extend towards the front surface 21 or the sidewalls 28 of housing 20. In yet other embodiments, as shown in FIG. 3C, the heat pipes 16 may be curved or angled such that when coupled to the first heat spreader 14, the heat pipes 16 are substantially perpendicular to the side surface 15 of the first heat spreader 14 and extend towards the sidewalls 28. These embodiments are but a few of the many different embodiments of the invention, and are not intended to limit the scope of the invention.

FIG. 3B discloses an embodiment of an assembly 35 according to the invention. The assembly 35 is similar to assembly 30 in that the heat pipes 16 can be mounted on a side surface 15, mount surface 13, or edge 11 of the first heat spreader 14. However, assembly 35 further discloses that the housing 20 has a curved front surface 21 with angled sidewalls 28 adjacent the curved front surface 21. An advantage of the housing 20 of FIG. 3B is that the curved front surface 21 can reflect the emitted light so it can be uniformly emitted. The light emitting device 12 can be positioned at the focal point of the curved front surface 21 to ensure that substantially all light emitted from the light emitting device 12 is reflected and emitted as uniform light. Additionally, the assembly 35 can have one or more heat pipes 16. For example, in one embodiment, a heat pipe 16 can be connected to the side surface 15 and extending to the housing 20. In yet another embodiment, the assembly 35 can have a heat pipe 16 connected to the mount surface 13 of the first heat spreader 14 and another heat pipe 16 connected to the side surface 15 of the first heat spreader. In a further embodiment, the assembly 35 can have three heat pipes 16 as shown in FIG. 3B. Again, these embodiments are but a few of the many different configurations, and are not intended to limit the scope of the invention.

FIGS. 4 and 5 show an embodiment of an assembly 40 according to the invention. The assembly 40 comprises a housing including a planar surface 41 that faces a light emitting device 12. Assembly 40 is configured to be mounted onto a wall or ceiling and does not necessarily extend into the plenum area above the ceiling. However, in some embodiments the assembly 40 is configured to extend into the plenum area above the ceiling. Assembly 40 comprises a light emitting device 12, first and second heat spreaders 14, 18 and a heat pipe 16. Assembly 40 is further configured to comprise at least one connector 46 on a base 45 of housing 44 such that a dome-type lens 50 may be attached to assembly 40. The dome-type lens 50 may be a decorative lens that covers the light emitting device 12, or could be configured to perform a light altering effect to the light emitted, such as but not limited to wavelength conversion, dispersion, scattering and/or light shaping.

In another embodiment, the heat pipe 16 of FIG. 5 could be configured such that it comprises an extension 43 that extends beyond the first heat spreader 14 and comprise an attachment means 48 to attach the dome-type lens 50 to the assembly 40. For example, the extension 43 could comprise a threading or the like that extends beyond the dome-type lens 50 and adapted to receive a locking nut or the like to secure the dome-type lens 50 to the assembly 40. In some embodiments, the extension 43 also provides a thermal path to dissipate heat from the light emitting device 12, during operation, through the threading and through the housing 44 via the second heat spreader 18, whereas in other embodiments, the extension 43 does not necessarily provide a thermal path to dissipate heat when the assembly is in use. The extension 43 could be formed of a heat pipe, thermally conductive material, or non-thermally conductive material. The extension 43 further provides structural support for the dome-type lens 50 such that at least one connector 46 is not needed. However, in other embodiments the at least one connector 46 and extension 43 are both present to provide structural support for the dome-type lens 50. In yet another embodiment, the extension 43 may further comprise a control mechanism that is adapted to power-on or power-off the assembly, for example a pull-chain.

FIG. 6 shows an embodiment of an assembly 60 according to the invention. The assembly 60 comprises a light emitting device 12 on a first heat spreader 14, a heat pipe 16 coupled to the first heat spreader 14 wherein the heat pipe 16 extends towards and couples to a second heat spreader 62. The second heat spreader 62 is adapted to be mounted to a ceiling such that the light emitting device 12 is suspended from the ceiling. The assembly 60 further comprises a housing 64 remote from the second heat spreader and configured to enclose the light emitting device 12. The housing 64 is further adapted to provide indirect lighting as disclosed above and can also comprise light mixing and/or light shaping properties as disclosed above. The housing 64 can be made of different materials, such as but not limited to plastic, glass, metal or a combination thereof. At least one advantage of the assembly 60 is that the heat pipe 16 allows the housing 64 to have an architectural design without having a heat sink restricting the architectural design of the housing 64, whereas existing light assembly housing designs are constrained due to heat sink requirements, such as having a heat sink integrated into the housing in order to dissipate heat. The assembly 60 provides an efficient thermal path between the first heat spreader 14 and the second heat spreader 62 and to provide a desired lighting output. The heat pipe 16 is also adapted to provide structural support for the first heat spreader 14.

In other embodiments, the assembly 60 can be configured to be a down-light source to provide direct lighting, instead of an indirect light source. In the direct light source embodiments, the light emitting device 12 is on an opposite surface of the first heat spreader 14 such that the light from the light emitting device is emitted downward. The housing 64 not only has diffusing properties to mix and/or shape the light into a desired emission pattern, but the housing 64 also serves the purpose of concealing the internal components of the assembly 60 from view.

FIG. 7 shows an embodiment of an assembly 70 according to the invention. The assembly 70 comprises a light emitting device 12 on a first heat spreader 14, a heat pipe 16 coupled to the first heat spreader 14 wherein the heat pipe 16 extends towards and couples to a second heat spreader 72. The assembly 70 further comprises an extension 74 that is coupled to the heat pipe 16 at one end and coupled to a base 76 at another end such that the light emitting device 12 is suspended from a ceiling. The base 76 is configured to be mounted to a ceiling and provide structural support for the assembly 70. The second heat spreader 72 is adapted to be on an outer surface of a housing 78 and efficiently dissipate heat from the light emitting device 12. The housing 78 is remote from the base 76 and configured to enclose the light emitting device 12. The housing 78 is further adapted to be an indirect light source or a direct light source similar to assembly 60 and can also comprise light mixing and/or light shaping properties as disclosed above. The housing 78 can be made of different materials that are thermally conductive such that the housing also assists in dissipating heat from the light emitting device 12. However, in other embodiments the housing 78 can be made of non-thermally conductive materials. At least one advantage of the assembly 70 is that the housing 78 allows for the light emitting device 12 to be remotely positioned within the housing 78 to provide a desired light output. The assembly 70 provides a thermal path between the first heat spreader 14 and the second heat spreader 72 while minimizing the length of the heat pipe 16. In some embodiments the extension 74 can be made of thermally conductive materials to further assist in the heat dissipation. In yet other embodiments, the extension 74 can be made of non-thermally conductive material. At least one advantage of the assembly 70 is that the length that the housing 78 is suspended from the ceiling does not require the lengthening of the heat pipe 16. The extension 74 can be modified to alter the height that the housing 78 is suspended from the ceiling.

FIG. 8 shows an embodiment of an assembly 80 according to the invention. The assembly 80 comprises a light emitting device 12 on a first heat spreader 14, a heat pipe 82 coupled to the first heat spreader 14 wherein the heat pipe 82 extends towards and couples to a second heat spreader 89. The second heat spreader 89 is adapted to be mounted to a ceiling such that the light emitting device 12 is suspended from the ceiling. In some embodiments, the second heat spreader 89 can be mounted above the ceiling or within the ceiling. In yet other embodiments, the second heat spreader 89 can be embedded within or mounted onto a ceiling tile or similar structure, wherein the ceiling tile is a typical ceiling tile used in commercial or residential settings and/or is formed of thermally conductive materials to assist in the heat dissipation. The heat pipe 82 can be comprised of a plurality of portions or could be an individual heat pipe. In one embodiment, the heat pipe 82 comprises a first portion 84, a second portion 86 and a third portion 88, wherein the first portion 84 is coupled to the first heat spreader 14, the third portion 88 is coupled to the second heat spreader 89, and the second portion is coupled to both the first portion 84 and the third portion 88. The first and third portions 84, 88 can be formed of a copper heat pipe or other metallic heat pipe, whereas the second portion 86 can be a non-metallic low cost heat pipe or a heat conduit. In yet other embodiments the second portion 86 is further adapted to be flexible to allow the light emitting device 12 to be manipulated to provide a desired light output. At least one advantage of the assembly 60 is that the heat pipe 82 minimizes the length of the first and third portions 84, 88 of the heat pipe 82 while still providing an efficient thermal path between the first heat spreader 14 and the second heat spreader 89. Yet another advantage of the assembly 60 is that the assembly 60 can be configured to be either a direct light source or an indirect light source.

Although the present invention has been described in considerable detail with reference to certain configurations thereof, other versions are possible. The assembly according to the invention can be many different sizes, can be in different types of housings, and can be used in many different configurations. Therefore, the spirit and scope of the invention should not be limited to the versions described above.

We claim:

1. A lighting assembly, comprising:

a housing;

a first heat spreader;

a light emitting device remote from said housing and in thermal communication with said first heat spreader;

a heat pipe comprising a first end and a second end, said first end in thermal communication with said first heat spreader, said heat pipe adapted to provide structural support for said first heat spreader, said first heat spreader comprising an opening along a central vertical axis to receive said first end; and a second heat spreader in thermal communication with said housing, said second end of said heat pipe extending through said housing and in thermal communication with said second heat spreader, said first heat spreader, said heat pipe and said second heat spreader comprising parallel central vertical axes, wherein said housing comprises a thermally conductive material, wherein said second heat spreader is on an external surface of said housing, and said external surface is thermally conductive and in thermal communication with said light emitting device.

2. The lighting assembly of claim 1, wherein said light emitting device is mounted to a surface of said first spreader facing said housing.

3. The lighting assembly of claim 1, wherein said first spreader is on said first end of said heat pipe.

4. The lighting assembly of claim 1, wherein said second spreader is on said housing.

5. The lighting assembly of claim 1, said housing further comprising a front surface and a back surface opposite the front surface.

6. The lighting assembly of claim 5, said housing further comprising sidewalls adjacent said front surface.

7. The lighting assembly of claim 6, wherein said sidewalls are configured to be angled, curved, multi-faceted or a combination thereof.

8. The lighting assembly of claim 1, said second heat spreader comprising an opening to receive said second end of said heat pipe.

9. The lighting assembly of claim 1, said housing comprising a diffuse white reflector.

10. The lighting assembly of claim 1, wherein at least a portion of said first heat spreader is exposed to the ambient of said housing.

11. The lighting assembly of claim 1, said first heat spreader comprising a mount surface to mount said light emitting device.

12. The lighting assembly of claim 1, wherein said light emitting device emits substantially all light towards said housing.

13. The lighting assembly of claim 1, wherein said light emitting device comprises a plurality of light emitting diodes (LEDs) on said first heat spreader.

14. The lighting assembly of claim 13, wherein said plurality of LEDs emit white light during operation.

15. The lighting assembly of claim 1, wherein the length of said heat pipe determines the separation between said light emitting device and said housing.

16. The lighting assembly of claim 1, said housing comprising metal, steel, aluminum or a combination thereof.

17. A lighting assembly, comprising:

a housing;

a first heat spreader;

a light emitting device remote from said housing and thermal communication with said first heat spreader;

a heat pipe comprising a first end and a second end, said first end in thermal communication with said first heat spreader, said heat pipe adapted to provide structural support for said first heat spreader; and a second heat spreader in thermal communication with said housing, said second end of said heat pipe in thermal communication with said second heat spreader, wherein said housing comprises a thermally conductive material, wherein said second heat spreader is on an external surface of said housing, said external surface is thermally conductive and in thermal communication with said light emitting device, said first heat spreader further comprising a reflector adjacent said light emitting device.

18. A lighting assembly, comprising:

a housing comprising a front surface;

a first heat spreader;

a light emitting device mounted on said first heat spreader;

a plurality of heat pipes in thermal communication with said first heat spreader, wherein at least two of said heat pipes have a thermal path to said first heat spreader independent from the other heat pipes; and a plurality of second heat spreaders on said housing, wherein each of said plurality of second heat spreaders is in thermal communication with a respective one of said plurality of heat pipes, wherein said plurality of heat pipes extend through said housing, wherein said housing comprises a thermally conductive material, wherein said plurality of second heat spreaders are on an external surface of said housing, said external surface is thermally conductive and in thermal communication with said light emitting device.

19. The lighting assembly of claim 18, said housing further comprising sidewalls adjacent said front surface.

20. The lighting assembly of claim 19, wherein said plurality of second heat spreaders are on an external surface of said sidewalls of said housing.

21. The lighting assembly of claim 19, wherein said sidewalls are configured to be angled, curved, multi-faceted or a combination thereof.

22. The lighting assembly of claim 18, wherein said plurality of heat pipes extend from said first heat spreader towards said sidewalls.

23. The lighting assembly of claim 18, wherein said plurality of heat pipes are adapted to provide structural support for said first heat spreader.

24. The lighting assembly of claim 18, wherein said front surface is unobstructed.

25. The lighting assembly of claim 18, wherein said first and second heat spreaders comprise an opening to receive said respective heat pipe.

26. The lighting assembly of claim 18, said housing comprising a diffuse white reflector.

27. The lighting assembly of claim 18, wherein said front surface of said housing is planar.

28. The lighting assembly of claim 18, wherein said front surface of said housing is curved.

29. The lighting assembly of claim 18, wherein at least a portion of said first heat spreader is exposed to the ambient outside of said housing.

30. The lighting assembly of claim 18, wherein said light emitting device emits substantially all light towards said housing.

31. The lighting assembly of claim 18, wherein said light emitting device comprises a plurality of light emitting diodes (LEDs) on said first heat spreader.

32. The lighting assembly of claim 31, wherein said plurality of LEDs emit white light during operation.

33. The lighting assembly of claim 18, said housing formed of a thermally conductive material to dissipate heat from said second heat spreader.

34. The lighting assembly of claim 33, said housing comprising metal, steel, aluminum or a combination thereof.

35. A lighting assembly, comprising:

a housing comprising a front surface;

a light emitting device remote from said housing and facing said housing, wherein said light emitting device is in thermal communication with said housing, wherein said housing comprises a thermally conductive material, wherein said light emitting device emits substantially all light towards said front surface; and a heat pipe coupled to said housing and said light emitting device to form a thermal path between the light emitting device and said housing, wherein said heat pipe extends through a central vertical axis of a first heat spreader and exposes a portion of said heat pipe opposite said light emitting device.

36. The lighting assembly of claim 35, said light emitting device on said first heat spreader, such that said first heat spreader is in thermal communication with said heat pipe.

37. The lighting assembly of claim 35, wherein said housing is thermally conductive and comprises a second heat spreader on said housing and coupled to said heat pipe.

38. The lighting assembly of claim 35, said housing further comprising at least one connector, said at least one connector adapted to receive a dome-type lens such that said dome-type lens is attached to said housing.

39. A lighting assembly, comprising:

a housing comprising a front surface;

a light emitting device remote from said housing, wherein said light emitting device is in thermal communication with said housing, wherein said housing comprises a thermally conductive material, wherein said light emitting device emits substantially all light towards said front surface;

a heat pipe coupled to said housing and said light emitting device to form a thermal path between the light emitting device and said housing, wherein said heat pipe extends through said first heat spreader and exposes a portion of said heat pipe opposite said light emitting device; and a dome-type lens configured to contact the housing and encase the light emitting device, wherein said portion of exposed heat pipe is adapted to receive said dome-type lens and lock in place.

40. A lighting assembly, comprising:

a light emitting device mounted on a first heat spreader;

a second heat spreader remote from said first heat spreader;

a heat pipe coupled to and extending between said first and said second heat spreaders, wherein said heat pipe extends through a central vertical axis of said light emitting device and said first heat spreader, wherein said heat pipe is adapted to provide structural support for said first heat spreader;

a housing that surrounds said light emitting device, said housing comprising light diffusing properties, wherein said heat pipe extends through said housing, wherein said second heat spreader is on an external surface of said housing, wherein said second heat spreader is in thermal communication with said external surface through at least an additional thermal path independent of said heat pipe.

41. The lighting assembly of claim 40, wherein said lighting assembly is a troffer light.

42. The lighting assembly of claim 40, wherein said lighting assembly is a recessed light.

43. The lighting assembly of claim 40, wherein said second heat spreader is adapted to be mounted to a ceiling.

44. The lighting assembly of claim 40, further comprising:

a base adapted to be mounted to a ceiling and receive said heat pipe.

45. The lighting assembly of claim 44, wherein said second heat spreader is on said housing.

46. The lighting assembly of claim 40, wherein said heat pipe is comprised of a plurality of portions.

47. The lighting assembly of claim 46, wherein said heat pipe comprises a first portion, a second portion and a third portion.

48. A lighting assembly, comprising:

a light emitting device mounted on a first heat spreader;

a second heat spreader remote from said first heat spreader; and a heat pipe coupled to and extending between said first and said second heat spreaders, wherein said heat pipe is comprised of a plurality of portions, wherein said heat pipe comprises a first portion, a second portion and a third portion, wherein said first and third portions are formed of materials having higher thermal conductivity than the material of said second portion.

49. A lighting assembly, comprising:

a light emitting device mounted on a first heat spreader;

a second heat spreader remote from said first heat spreader;

a heat pipe coupled to and extending between said first and said second heat spreaders, wherein said heat pipe is adapted to provide structural support for said first heat spreader, wherein said heat pipe comprises a first portion, a second portion and a third portion, wherein said second portion is a flexible heat conduit; and a housing that surrounds said light emitting device, said housing comprising light diffusing properties, wherein said heat pipe extends through said housing.

50. The lighting assembly of claim 40, wherein substantially all light emitted from said light emitting device is substantially emitted towards said housing prior to being emitted from said housing, such that said lighting assembly is an indirect light source.

* * * * *